US012358042B2

(12) United States Patent
Olejnik et al.

(10) Patent No.: US 12,358,042 B2
(45) Date of Patent: Jul. 15, 2025

(54) CAST STRUCTURAL ELEMENT OF A PUMP, FILTER OR COMPRESSOR WITH WEAR RESISTANT LAYER COMPRISING COMPOSITE MATERIAL BASED ON ALLOYS REINFORCED WITH TUNGSTEN CARBIDE AND THE METHOD OF PRODUCING THEREOF

(71) Applicants: Innerco SP. Z O.O, Cracow (PL); Eurocast Industries Ltd., Warminster (GB)

(72) Inventors: Ewa Olejnik, Skala (PL); Przemyslaw Czapla, Cracow (PL)

(73) Assignees: Innerco SP Z.O.O., Cracow (PL); Eurocast Industries LTD, Warminster (GB)

( * ) Notice: Subject to any disclaimer, the term of this patent is extended or adjusted under 35 U.S.C. 154(b) by 119 days.

(21) Appl. No.: 17/606,894

(22) PCT Filed: Apr. 30, 2019

(86) PCT No.: PCT/PL2019/050029
§ 371 (c)(1),
(2) Date: Oct. 27, 2021

(87) PCT Pub. No.: WO2020/222663
PCT Pub. Date: Nov. 5, 2020

(65) Prior Publication Data
US 2022/0212247 A1 Jul. 7, 2022

(51) Int. Cl.
*C22C 29/08* (2006.01)
*B22C 3/00* (2006.01)

(52) U.S. Cl.
CPC ..... *B22C 3/00* (2013.01); *C22C 29/08* (2013.01)

(58) Field of Classification Search
None
See application file for complete search history.

(56) References Cited

U.S. PATENT DOCUMENTS 8,535,000 B2 * 9/2013 Chiovelli ..... F04D 29/2294 415/206

FOREIGN PATENT DOCUMENTS

AU 2012201390 A1 * 2/2013
CN 102423799 B * 2/2013
(Continued)

OTHER PUBLICATIONS

A. S. Shchukin et al., "Evolution of Gases during SHS of TiC", International Journal of Self Propagating High Temperature Synthesis, vol. 24, No. 4, 2015, pp. 226-229.

*Primary Examiner* — Kim S. Horger
(74) *Attorney, Agent, or Firm* — GableGotwals

(57) ABSTRACT

A cast structural element of a pump, filter or compressor is disclosed with wear resistant layer comprising in situ produced composite material based on alloys, especially cast iron based alloys, reinforced with tungsten carbide in the form of crystals and/or particles, characterized by the microstructure of the composite material within the layer comprising faceted crystals and/or faceted particles tungsten carbide that provide uniform macroscopic and microscopic distribution, wherein the crystals and/or particles of tungsten carbide include irregular and/or round and/or oval nano and/or micro-areas filled with alloy based on metal. A method of producing the cast structural element in the form of a pump, filter or compressor is also disclosed.

10 Claims, 6 Drawing Sheets

(56) References Cited

FOREIGN PATENT DOCUMENTS

| | | | |
|---|---|---|---|
| CN | 105714166 | A | 6/2016 |
| CN | 109578321 | A | 4/2019 |
| WO | WO 2017081665 | A1 | 5/2017 |

* cited by examiner

CAST STRUCTURAL ELEMENT OF A PUMP, FILTER OR COMPRESSOR WITH WEAR RESISTANT LAYER COMPRISING COMPOSITE MATERIAL BASED ON ALLOYS REINFORCED WITH TUNGSTEN CARBIDE AND THE METHOD OF PRODUCING THEREOF

CROSS-REFERENCE TO RELATED APPLICATIONS

This United States application is the National Phase of PCT Application No. PCT/PL2019/050029 filed 30 Apr. 2019 which is incorporated herein by reference.

BACKGROUND OF THE INVENTION

The invention relates to cast structural element of a pomp, filter or compressor with a layer comprising composite material based on alloys, especially iron base alloys. Due to the layer comprising composite material reinforced with tungsten carbide, the structural element characterize with increased hardness and resistance to abrasive wearing. The object of the invention is the method of producing the layer of a composite material using a hydraulic device.

One of the major problems related to the frequency of replacing the hydraulic devices, such as e.g. pumps or compressors, is the excessive wear of their surfaces. Such wear affects the loss of the initial dimensions and shape causing deterioration or total loss of functional features of a given structural element. This necessitates frequent replacement of these elements what reduces profitability of the machines and devices users. This common phenomenon inspires to design functional elements of the machines with reinforced outer surface. Thickness and shape of the area of the layer being worn depends on the operating conditions of a given detail and can be from one to a few several tens of millimetres. This problem especially applies to such industry sectors where hydraulic devices are used to transfer fluid or gas.

There are many material solutions known in the art that allow for increasing the resistance to abrasive wear of hydraulic device elements. They mostly include various types of cast alloys and alloys for metal forming. Solutions aimed at producing functional casts are more often applied, i.e. having hard and wear resistant outer layer and more plastic core. In this field, materials applied using welding, laser and plasma techniques are predominating. The feature that distinguishes wear resistant materials is the high content of ceramic phases, mostly carbides arranged within a properly selected metal or cast alloy based matrix. Composite materials the most resistant to wear comprise ceramic phases within its structure in the form of titanium carbide (TiC), tungsten carbide (WC) or the combinations thereof in amounts not exceeding 50% by volume. High volume fraction of the mentioned carbides cause that the materials applied on machine parts or semi-finished products show much greater resistance to wear than the most wear resistant abrasive cast alloys or these designed for metal forming.

However, using state of the art technologies is expensive and time-consuming because of the costs of using two or more technological processes and a series of intermediate operations in order to produce a final detail. The other important drawback of the padding and alloying technologies known in the art, is the practical lack of the option or difficulties in applying the layers or coatings resistant to abrasive wear at difficult to reach locations or in places of complicated shapes, e.g. bent pipes, internal surfaces of pumps, areas of machines and devices parts difficult to reach for welding tools. Roughness of padded surfaces is relatively high, which fact in many cases is a limitation in using this group of methods in production of wear resistance elements of machines and devices. Another significant drawback in production of abrasive wear resistance layer using welding techniques is the need to previously prepare a surface where the layer is to be applied on. Incorrectly prepared surface causes embrittlement of the applied material. At the same, in case of percussion applications, one may often observe embrittlement of fragments of the applied materials, which fact leads to reduction of the life.

There are other solutions known in the art that increase the resistance to abrasive wear of the top layer of machines and devices elements, wherein the composite layers reinforced with ceramic phases, e.g. TiC, are made in situ, directly during the casting process. They consist in applying a coating comprising a mixture of powders, substrates of the TiC formation reaction and fluid, i.e. alcohol, on the mould cavity and then the mould is subjected to drying and pouring with liquid alloy based on iron. Such method is presented in the Polish patent application PL414755 A. The solutions allows for creating a composite layer within the cast, reinforced with oval TiC crystals or particles, however the layer obtained using this method is not continuous and uniform and may have numerous defects in the form of gaseous roughness. The problem results from the fragmentation and gas emission phenomenon that accompany the reaction of synthesis of pure TiC. The problem of gas emission during SHS reactions is discussed in the paper of Shchukin (Shchukin AS, Savchenko SG (2015). *International Journal of Self-Propagating High-Temperature Synthesis,* 24, pp. 227-30), where it is proven that within the first SHS TiC reaction, there is rapid degassing of compacted Ti and C powders together with the release of significant volumes of gases. This leads to encapsulating the released gases during crystallization of the alloy in the form of bubbles forming roughness within the zone of composite layer. Increase of the alloy temperature within the reaction area is a result of the release of a thermal energy that accompanies highly exothermic TiC synthesis reaction, enthalpy of creating this phase is-187 KJ/mol. For comparison purposes, enthalpy of forming WC is-32 KJ/mol, copper (Cu) only-13 KJ/mol. Unfavourable phenomenon of fragmentation is discussed in the international patent application WO2017081665 concerning in situ production of TiC reinforced composite zones within casts. It discloses that reactive infiltration during TiC synthesis, at the presence of liquid alloy, leads to separation of the composite zone fragments which then are shifted within the mould cavity. In extreme cases, it affects total destruction of the local reinforcement or causes increase of the volume of the matrix at the cost of TiC particles. This phenomenon is defined as composite zones fragmentation. Presence of roughness and non-uniformity of phases displacement reinforced within the composite layer area affects deterioration of hardness and resistance to abrasive wear.

State of the art presents also the European patent application EP2334836 B1 that discloses a composite material of hierarchic structure that includes iron base alloy reinforced with oval particles of TiC according to predefined geometry, wherein the reinforced part includes alternating macrostructure of millimetre zones enriched with micrometric agglomerates of spherical TiC particles separated by millimetre zones basically deprived to micrometric spherical TiC zones, wherein such enriched micrometric spherical TiC particles form a microstructure, where micrometric gaps between these spherical particles are also filled by the iron base alloy. The above application also discloses a method of producing through casting a composite material of hierarchic structure.

BRIEF SUMMARY OF THE INVENTION

The objective of the solution according to this invention was the development of a structural element of a pump, filter or compressor with a layer comprising composite material based on alloys reinforced with tungsten carbide of increased hardness and resistance to abrasive wear within the operating zones through providing, within it, evenly distributed hard and resistant to abrasive wear crystals/particles of tungsten carbide. At the same time, the invention solves the problem of fragmentation and high infiltration that accompanies the TiC in situ synthesis reaction. Both these phenomena may cause damage to the composite layer when it comes to total fragmentation or significantly reduce the TiC particles content within the zone due to high degree of infiltration, which cannot be physically avoided due to highly exothermic character of the TiC synthesis reaction. During the in situ TiC synthesis, the amount of infiltration of liquid alloy within the composite zone can be limited using certain methods, however the final share of TiC carbide shall never reach such level than can be reached using compounds and methods according to the invention in case of tungsten carbide. This is a technical progress in the field of producing layers reinforced with tungsten carbide resistant to abrasive wear in the cast parts of devices.

According to the invention, method of producing layers in hydraulic devices of composite materials reinforced with tungsten carbide particles of specific morphology is also proposed. Solution according to the invention consisting in in situ production, i.e. directly in the cast mould within a single stage process, of layers in hydraulic devices of composite materials reinforced with tungsten carbide or mixture of different types of tungsten carbide that eliminates the aforementioned drawbacks.

The objective of the invention is the structural element of a pump, filter or compressor with the wear resistant in situ produced layer comprising composite material based on alloys, especially cast iron base alloys, reinforced with tungsten carbide in the form of crystals and/or particles that can be characterized by the fact that the microstructure of the composite material within the layer comprising faceted crystals and/or faceted particles of tungsten carbide, forming a uniform macroscopic and microscopic distribution, wherein the crystals and/or particles of tungsten carbide include irregular and/or oval and/or round nano and/or micro zones filled with an alloy based on metal.

Preferably, irregular and/or oval and/or round nano and/or micro zones filled with an alloy based on metal are located within the internal part of the crystals and/or particles of tungsten carbide, and within the external part, near the walls, their structure is uniform, and the crystal and/or particles are formed in situ within liquid alloy and are present within the matrix, the said matrix is formed after the alloy crystallization process.

Preferably, the volume of at least on type of tungsten carbide within the layer comprising composite material is 15 to 50% by volume, especially between 19 and 35% by volume.

Preferably, the size of crystals and/or particles of tungsten carbide within the zone comprising the composite material is between 0.5 and 30 μm.

Preferably, within the area of the crystal and/or particle of tungsten carbide within the zone comprising the composite material, size of the areas filled with metal or alloy is between 0.1 and 4.5 μm.

Preferably, layer comprising composite material includes additional types of tungsten carbide or borides subjected to self-propagating high temperature synthesis reaction, especially TiC, MoC, NbC, ZrC, VC, TaC, TaB, $TiB_2$ or the mixes thereof, except for SiC, which is thermodynamically in iron alloys and is dissolved in them.

The subject of the invention is also the mix of powders for producing composite material comprising tungsten carbide within the layer of the structural element specified according to the invention, that characterize with the fact that the powder of tungsten and/or carrier of high tungsten content within the range 90-97% wt. and carbon, especially in the form of high purity carbon or other carrier of its high content or the mixes thereof within the scope 3-10% wt., preferably tungsten powder within the scope 93-95% wt., and carbon powder within the scope 5-7% wt., preferably tungsten powder in the amount of about 94% wt. and carbon in the form of graphite in amount about 6% wt.

According to another aspect, the object of the invention is the mixture of powders for producing the composite material comprising tungsten carbide in the layer of a structural element according to the invention, that can be characterized by that it comprises:

a. tungsten powder, especially in the form of microcrystalline or nanocrystalline powder and/or agglomerates of nanoparticles or other carrier of high tungsten content,
b. carbon powder, especially in the form of graphite or other carrier of high carbon content or their mixtures, and
c. catalyst in the form of substrates of carbon forming reactions, other than WC or boride, which are subject to self-propagating high temperature synthesis reaction, especially TiC, MOC, NbC, ZrC, VC, TaC, TaB, $TiB_2$ or the mixtures thereof, except for SiC.

The invention also applies to the method of producing a structural element specified according to the invention, including the following stages:

a. coating the cast mould cavity or core, especially sand core, with reactive liquid cast coating that includes a mixture of powders according to the invention and a carrier,
b. drying,
c. pouring the cast mould cavity with an alloy, especially iron base alloy, wherein heat supplied by the liquid alloy in the form of high temperature provides the energy necessary to initiate the in situ reaction of the ceramic phase in the form of at least one type of tungsten carbide or tungsten carbide with addition of other types of carbides that are subject to self-propagating high temperature synthesis reaction and represent a catalyst for the tungsten carbide synthesis reaction.

Preferably, the carrier is a solution of a solvent with an addition of a polymer. More preferably, the solvent is alcohol, especially ethyl alcohol. More preferably, the polymer is a resin of low gas emission, especially colophony.

Preferably, surface density of the reactive cast coating is within the range from 0.29 to 2 $g/cm^2$, more preferably from 0.29 to 0.6 $g/cm^2$, the most preferably 0.5 $g/cm^2$.

Preferably, percentage share of the powder mixture according to the invention to the carrier is 6:1 to 1:1, more preferably 4:1.

Preferably, before the powders are added to the cast coating carrier, they are dried at the temperature equal to or above 100° C.

One of the most common methods of producing in situ composites is the Self-propagating High-temperature Synthesis (SHS). The method is the basic method of producing composite materials in the powder metallurgy. However, despite many advantages including the low energy input necessary to initiate the ceramic phases syntheses and high output, the obtained products are characterized by high degree of porosity that significantly reduces mechanical and utility properties of the manufactured products. Therefore, there have been research works performed related to binding the SHS method with the conventional casting techniques, wherein the synthesis reaction initiation factor is high temperature of liquid cast alloy poured in the mould cavity. Application of such coupled methods allows for obtaining products deprived of casting defects that can be characterized by a very good bonding at the ceramic-matrix phases boundary, deprived of inclusions and with high mechanical properties.

In case of composite layers, the technological process of their production includes the creation of reactive cast coatings that include reactants of the ceramic phase formation reaction, mainly in the form of tungsten carbide or tungsten carbide with other additives of reactants that undergo SHS reaction. Supply of heat necessary for the ceramic phase in situ synthesis reaction to take place is obtained through introduction of liquid cast alloy into the cast form cavity. High temperature of liquid metal initiates the SHS reaction of tungsten carbide within the area of layer/coating comprising the composite material. The in situ formed reinforcement in the form of the composite layer can be characterized by a microstructure that is mostly represented by tungsten carbide particles or crystals 6 of tungsten carbide of characteristic morphology. They are separated from each other with the matrix areas formed after crystallization of liquid alloy poured into the form cavity. The phenomenon is a result of the reactive infiltration that takes place within the reactive cast coating applied in the mould cavity or core surface.

The mixture of powders representing substrates of tungsten carbide formation is prepared in a predefined stoichiometry. Preferable results are obtained for the mixture of powders wherein the mass fraction of tungsten is between 90 and 96% wt., and the rest is in the form of carbon, i.e. graphite or a carrier of high carbon content or mixtures thereof. More preferably, the mixture of powders representing substrates for creating tungsten carbide amounts about 94% wt. of tungsten and about 6% wt. of carbon in the form of graphite or other carrier of high carbon content or mixtures thereof. The prepared powders mixtures are subjected to homogenization process in order to homogenize the properties within the whole mixture volume. Within another step, they are subjected to drying at temperature at least 100° C. in order to eliminate alcohol and moisture absorbed on powders surface. They represent the base material to produce reactive cast coatings in order to manufacture composite layers in cast elements of pumps, filters and compressors.

The term reactive cast coating means the mixture of powders comprising reactants of the carbides and/or borides formation reactions that are subject to SHS reaction, the components of which are represented by powders of graphite and tungsten and a carrier. Preferably, beside the powders of tungsten and graphite and the carrier, the reactive coating may include other additives in the form of substrates of the reaction forming titanium carbide or other carbides and/or borides, with the exception of SiC. The technological process of forming the composite material reinforced with the application of the reactive cast coatings, includes: preparation of weighed amount of ceramic phase forming substrates powder homogenized within the whole volume; then, alcohol solution with an addition a polymer, e.g. colophony which is used as an air-drying gluing agent is added to the powder mixture, and affects the physical and chemical and technological properties of the coatings; next, at least on layer of the obtained composition, representing the cast coating is being applied on the cast core or into the casting mould cavity using a brush, immersion or spray, wherein, at the initial stage of the process, each of the applied layers is dried in order to eliminate the thermal decomposition products of the applied solvent and additives. Then, the cavity of the casting mould without or with the casting core is filled with the alloyed material from among the group of alloys based on iron, however the synthesis reaction is conditioned by suitable temperature of the basic alloy and its proper construction of the filling arrangement. Similarly, instead of using alloys based on iron, it is possible to use other cast alloys, e.g. based on cobalt or nickel, wherein the synthesis reaction can be initiated. The key parameter of the process is the heat balance between the reactive cast coating applied on the mould cavity and/or core, which includes powders of WC forming reaction substrates, and the liquid alloy in the casting and its selection so that the heat amount allows for initiating the reaction. When the amount of heat within the mould cavity is not enough, the WC synthesis reaction is not going be initiated and the composite layer reinforced with WC shall not form in the cast. The heat balance parameter should be determined experimentally or empirically for a given type of cast of specified weight and shape. Application of additives in the form of substrates of TiC formation reaction with predefined percentage share is to support the WC synthesis reaction course, increase the amount of the generated energy during reaction, which fact provides for the option of creating thicker and better filtered layers. The amount of TiC substrate additives as the WC formation reaction catalyst must be selected experimentally or empirically for a given shape or weight of a cast. The role of the catalyst can be played by the substrates of a reaction forming carbide other than TiC or boride that are subject to self-propagating high temperature synthesis reaction, especially TiC, MoC, NbC, ZrC, VC, TaC, TaB, $TiB_2$. From among the carbides, SiC cannot be the catalyst, which is thermodynamically unstable in iron alloys and dissolves.

Parameter that defines the amount of cast coating applied on the casting mould cavity or casting core is the surface density that should be interpreted as a weight of the cast coating to the area expressed in $g/cm^2$. Surface density of the applied reactive cast coating according to the invention is within the range from 0.29 $g/cm^2$ to 2 $g/cm^2$, preferably from 0.29 to 0.6 $g/cm^2$, the most preferably it is 0.5 $g/cm^2$.

Mass fraction of the powder mixture representing the tungsten carbide forming reaction substrates is from 1 to 6 parts by weight to 1 parts by weight of the carrier. More preferably, the mass ratio of the mixture representing the tungsten carbide forming reaction substrates to the carrier is 4:1.

The carrier was developed in order to increase adhesion of the coating to the casting mould cavity. The carrier can be a solution of a binder in the form of a polymer of low degree of gas emission within the solvent in the form of an alcohol of percentage concentration preferably between 1 and 20% wt. The best results were achieved with the carrier composed of a 8 to 10% wt. solution of colophony with ethyl alcohol. Application of materials characterizing with low degree of gas emission during thermal decomposition prevented formation of roughness within the composite layer area.

BRIEF DESCRIPTION OF THE DRAWINGS

The invention is presented in embodiments that do not limit the protective scope of the invention and on the following figure, wherein.

DESCRIPTION OF THE INVENTION

Example 1

Figure 1:
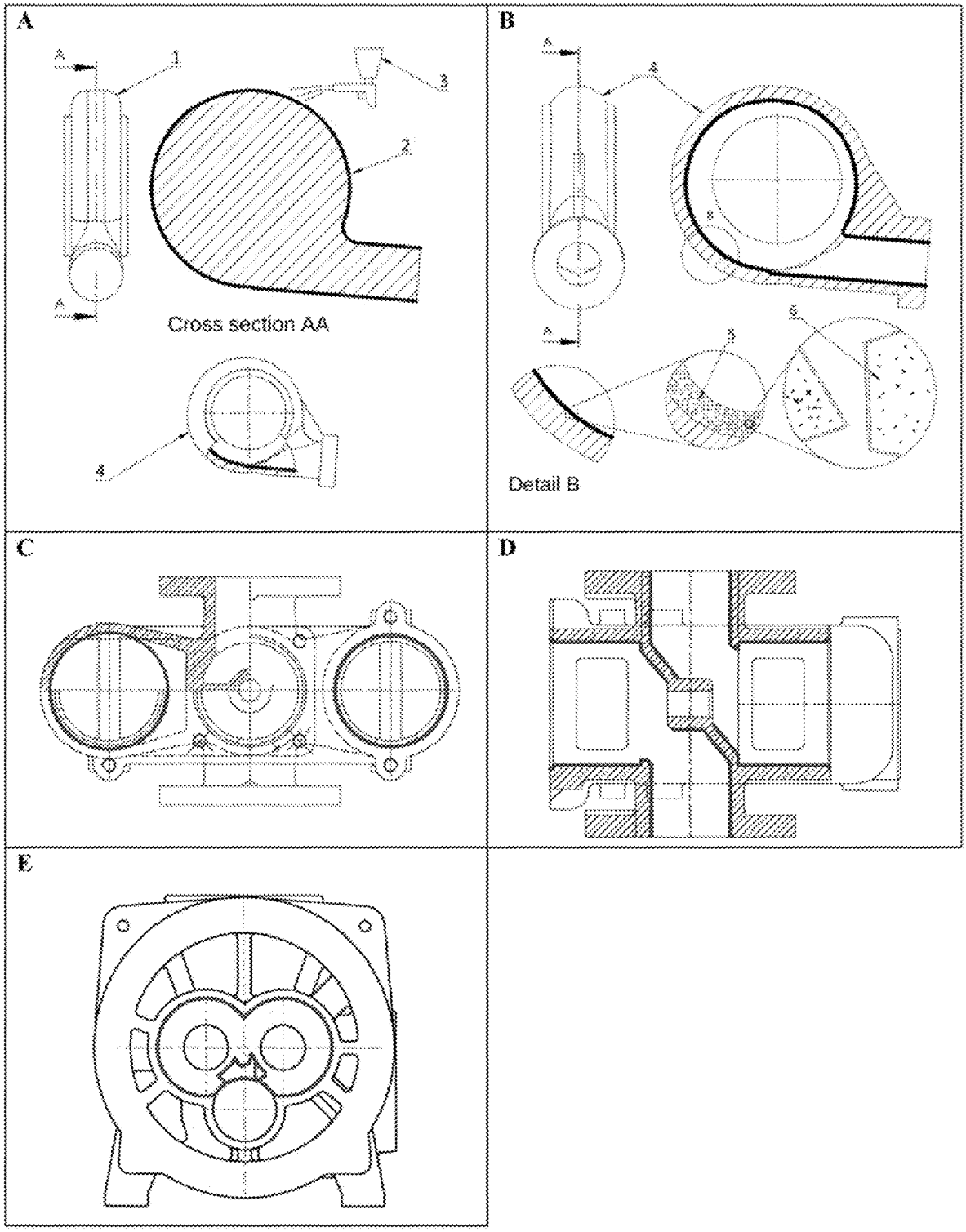
FIG. 1 presents (A) diagram of the core cross-section, representing an element of the casting mould to form a pump body cast with the applied composite layer that includes crystals/particles of tungsten carbide, (B) diagram of the pump with the layer comprising composite material, (C) and (D) diagram of the filter cross-section with the layer comprising the composite material, (E) diagram of the compressor cross-section with the layer including composite material.
Figure 2:
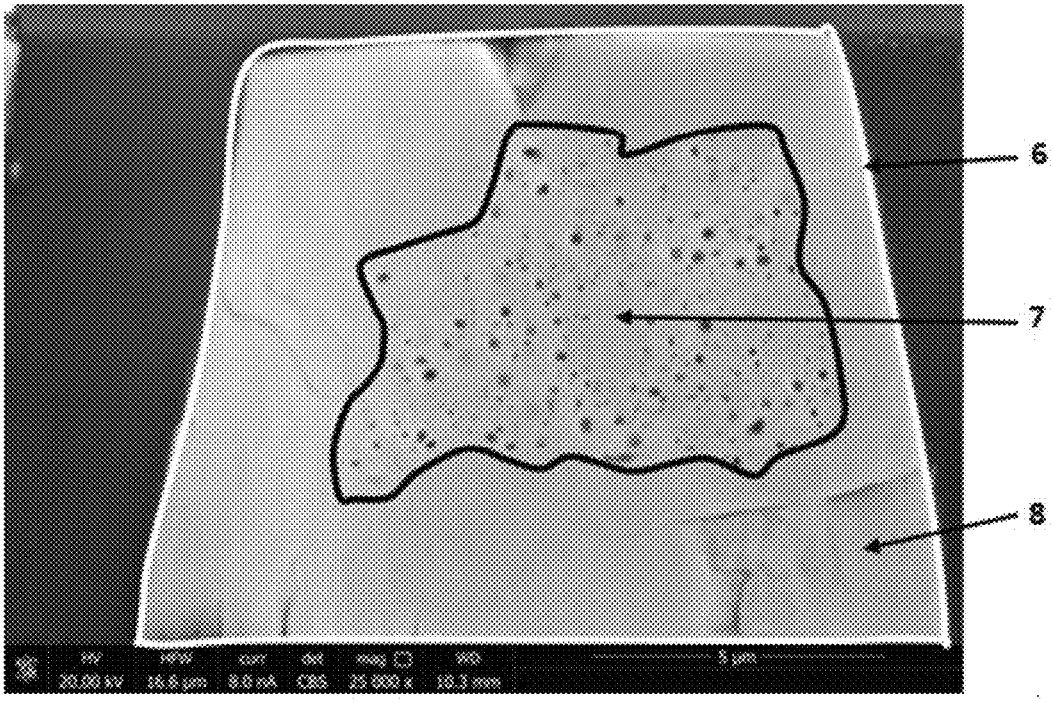
FIG. 2 presents the characteristic microstructure of faceted tungsten carbide crystal within the layer including irregular oval areas filled with an alloy based on metal.

According to one embodiment, the casting mould core 1 of the mould to produce the pump body casting is coated with the reactive coating 2 using a sprayer 3, as shown in the FIG. 1A. As a result, pump 4 body casting with the layer 5 comprising composite material (FIG. 1B) produced in situ in produced with visible morphology of wall-like tungsten carbide crystals and/or particles 6 consisting of two forms, one in the internal part of a particle comprising oval areas filled with the alloy and another in the external part of a particle deprived of areas filled with the tungsten carbide crystals and/or particles 6, as shown in the FIG. 2. Layers 5 comprising the composite material may also be form on the filter (FIG. 1C, 1D) or compressor (FIG. 1E).

Figure 7:
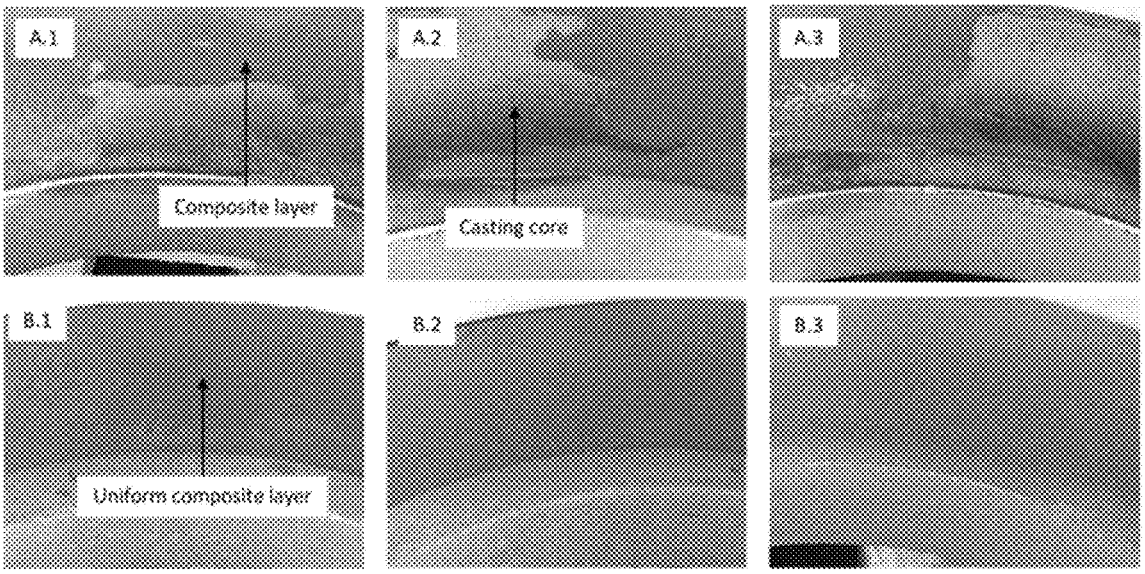
FIG. 7 presents photos of the grey cast iron cast with the composite layer produced in situ, obtained with the use of different surface densities of the cast reactive coating according to the invention.

To form the layer 5 of WC reinforced composite in the internal surface of the pump 4 body subject to intense wear, cores of the casting moulds core 1 are prepared. The reactive cast coating 2 was applied directly on the surface of the casting mould cores 1 made of quartz sand and furan resin. The coating 2 is made by mixing tungsten powder of particle size ca. 5 μm and graphite powder of particle size ca. 5 μm. The mixture of powders was made using 96% wt. of tungsten and 4% wt. of graphite as well as 94% wt. of tungsten and 6% wt. of graphite in the first and second cast coating respectively. Then, the weighed amounts of powders were introduced into liquid solution of resin in the alcohol representing the carrier and air dried gluing agent. Mutual ratio of the tungsten and graphite powders mixture to liquid solution of gluing agent in both cases was 4:1 parts by weight. The whole was subject to mixing in order to obtain uniform reactive consistency of the cast reactive coating. The mixed reactive cast coating 2 was applied by means of a spray gun 3 on the casting mould core 1, representing the internal shape of the pump 4. The coating 2 was applied in layers until obtaining surface density 0.5 g/cm$^2$ and 0.45 g/cm$^2$ respectively for the layer number 1 and 2. Then, the casting mould cores 1 were dried followed by installation in the mould cavity, and then each of the moulds was assembled and filled with liquid alloy of temperature 1380° C. Using the aforementioned method, two bodies of the pump were made wherein each of them had the core area equal to ca. 3789 cm$^2$. In both cases, the produced castings had cores with a microstructure characteristic for grey cast iron with separated flake graphite whose outer surface was reinforced with the composite layer 5 comprising (WC) tungsten carbide crystals and/or particles 6. Application of the casting mould cores 1 of the same area and similar surface density of the applied reactive coating 2 was intended and performed in order to show the impact of the applied stoichiometry of the powders mix on the continuity of the composite layer. The results are presented in the FIGS. 7A.1-A.3 and B.1-B.3. The observations showed that application of the powders mix of composition representing 96% wt. W to 4% wt. C allowed for obtaining the continuity of the layer at the level ca. 80%, and in case of the composition 94% wt. W to 6% wt. C specified in the patent application as designed for producing the in situ composite layer, characterized with the continuity at the level of 100%.

In both types of pumps bodies, composite layers were reinforced with tungsten carbide, using reactive casting coatings of surface density given in Table 1, in order to obtain continuity at the level between 100% and 80% of the pump internal surface. This shows that together with the increase of share of atomic tungsten in the powders mixture, the synthesis reaction deteriorates resulting in lack of continuous composite layer. Continuity of the layer at the level of 80% is acceptable in industrial application.

TABLE 1

| No. | Core surface [cm$^2$] | Mass fraction, [% wt.] W | C | Surface density of the reactive cast coating [g/cm$^2$] | Weight of the applied coating [g] | Protective coating | Layer continuity [%] |
|---|---|---|---|---|---|---|---|
| 1. | 3247.52 | 94 | 6 | 0.29 | 1000 | not available | 100 |
| 2. | 3247.52 | 94 | 6 | 0.4 | 1300 | not available | 100 |
| 3. | 3789.62 | 94 | 6 | 0.29 | 1100 | not available | 100 |
| 4. | 3789.62 | 94 | 6 | 0.4 | 1500 | not available | 100 |
| 5. | 3789.62 | 94 | 6 | 0.5 | 1894.5 | not available | 100 |
| 6. | 3247.52 | 96 | 4 | 0.29 | 1000 | not available | 100 |
| 7. | 3247.52 | 96 | 4 | 0.4 | 1300 | not available | 100 |
| 8. | 3789.62 | 96 | 4 | 0.29 | 1100 | not available | 100 |
| 9. | 3789.62 | 96 | 4 | 0.4 | 1500 | not available | 100 |
| 10. | 3789.62 | 96 | 4 | 0.5 | 1894.5 | not available | 90 |
| 11. | 3247.52 | 96 | 4 | 0.5 | 1623.76 | not available | 90 |
| 12. | 3247.52 | 96 | 4 | 0.5 | 1623.76 | applied | 80 |
| 13. | 3247.52 | 96 | 4 | 0.6 | 1623.76 | not available | 80 |

Figure 3:
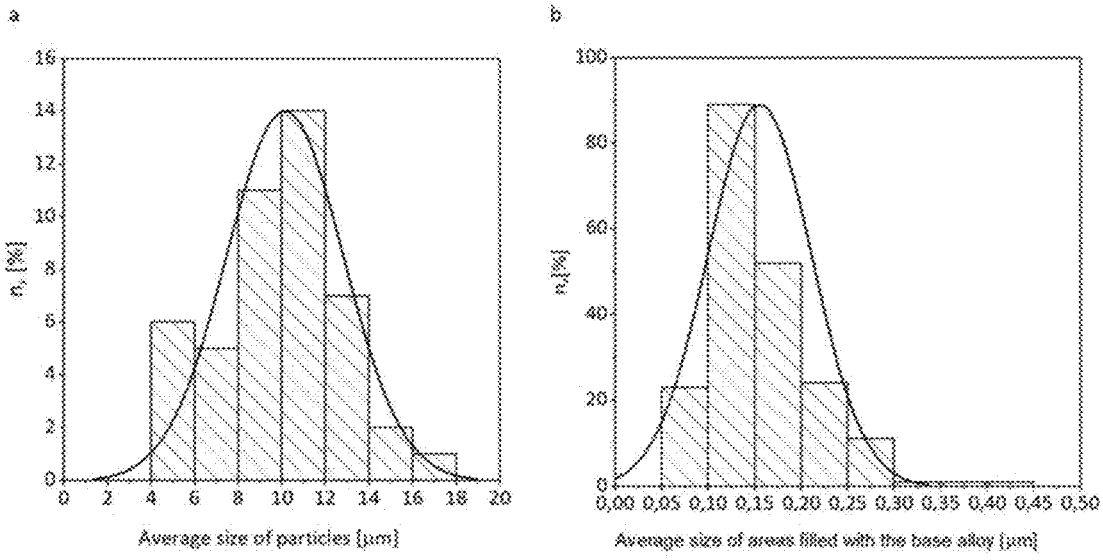
FIG. 3 presents histograms of the tungsten carbide particles/crystals size distribution as well as sizes of areas filled with the alloy within the area of individual particles/crystals of tungsten carbide.

As a result of the synthesis reaction, local composite reinforcements reinforced with particles of at least one tungsten carbide type, are formed in the cast steel casting. The core 1 of the casting, after the crystallization process had the microstructure characteristic for the given grade of the alloy, however the in situ tungsten carbide crystals and/or particles 6 are formed within the casting pad area. Such a tungsten carbide crystals and/or particles 6 has a morphology consisting of two different areas. One of the areas is within the internal part of the tungsten carbide crystals and/or particles 6 of tungsten carbide and comprise micro-areas 7 of shape similar to oval, filled with an alloy based on metal, and the other one is a rim 8 surrounding it deprived of oval micro-areas filled with alloy, as showed in the FIG. 2. Average particle size preferably is within the range from 4 to 18 μm, average size of areas filled with the base alloy is from 0.05 to 0.45 μm, as showed in the FIG. 3.

The wear index-determined using the Ball-on-disk method—of the layer 5 with composite material reinforced with tungsten carbide in the pump body casting of grey cast iron with flake graphite, representing the base alloy, is from 5 to $8*10^{-6}$ mm$^3$/N*m, and in the pump body of grey cast iron with flake graphite representing the base alloy without the reinforcement layer is $37.6*10^{-6}$ mm$^3$/N*m. I.e. the layer with the composite material according to the invention wear from 4.7 to 7.5 times less comparing to the pomp made of grey cast iron.

Example 2

Figure 4:
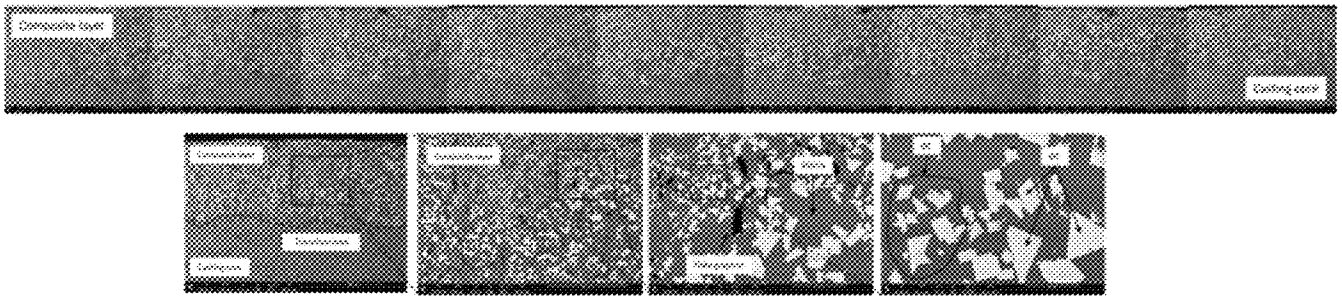
FIG. 4 presents the microstructure of the composite layer cross-section produced in situ in the cast, reinforced with tungsten carbide particles/crystals together with selected, magnified areas.
Figure 5:
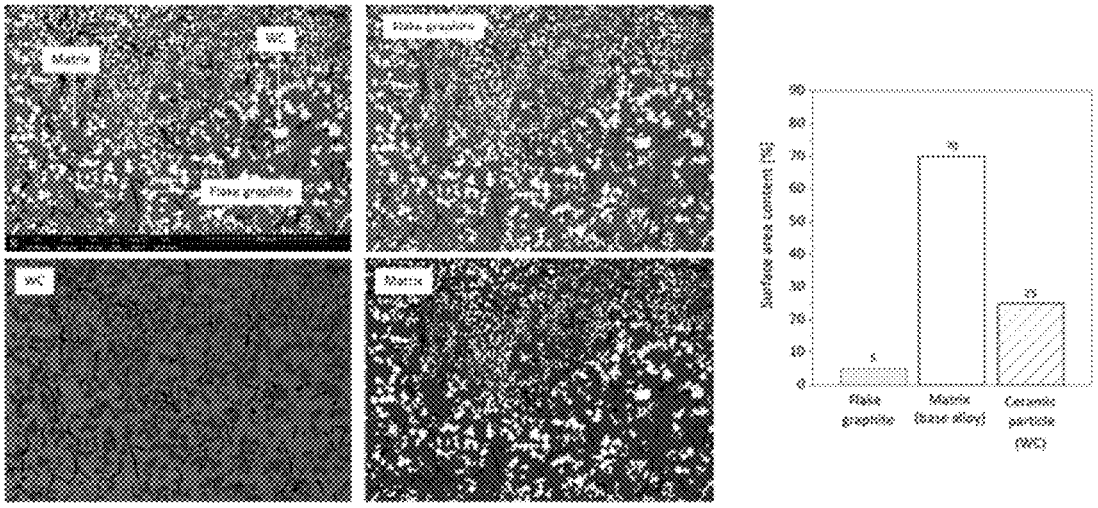
FIG. 5 presents exemplary microstructures of the layer with the composite with determined surface area content of the ceramic phase, i.e. tungsten carbide, matrix of the composite layer and graphite surface area content being the component of grey cast iron used to produce the casting.
Figure 6:
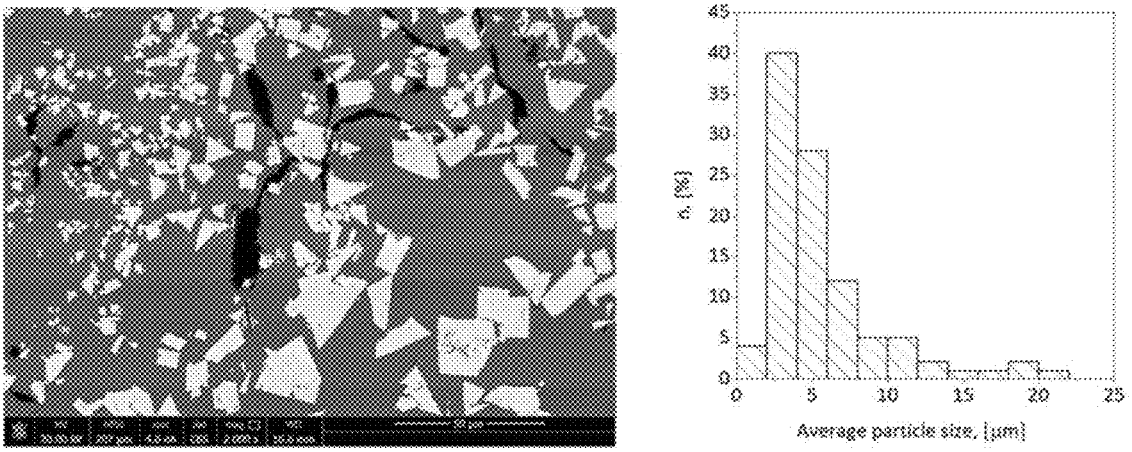
FIG. 6 presents the microstructure of the composite layer as well as average size of tungsten carbide particles determined as its two diagonals intersecting at the right angle.

In order to produce the in situ composite layer 5 reinforced with WC, the core based on sand and resin was prepared, representing an element of the casting mould core 1 based on quartz sand and water glass blown with $CO_2$. The casting mould core 1 cavity was coated with reactive cast coating 2. The coating 2 is made by mixing tungsten powder of particle size 5 μm and graphite powder of particle size ca. 5 μm. The mixture of the powders was made using 94% wt. of tungsten and 6% wt. of graphite. Then, the powders were introduced into liquid solution of colophony in the alcohol representing the carrier and air dried gluing agent. Mutual ratio of the tungsten and graphite powders mixture to liquid gluing agent was 4:1 parts by weight. The whole was subject to mixing in order to obtain uniform reactive consistency of the cast reactive coating. The mixed reactive casting coating 2 was applied by spraying with a spray gun 3. The coating 2 was applied in layers until obtaining surface density 0.29 g/cm$^2$ or 0.4 g/cm$^2$. Then, the casting mould cavity was baked in order to remove residues of alcohol and moisture follow by filling with liquid alloy at temperature ca. 1400° C. The casting, after the crystallization process had the microstructure of grey cast iron with flake graphite, however within the area of composite layer, the in situ tungsten carbide crystals and/or particles 6 were formed, having a structure formed of two different areas. One of the areas is within the internal part of the tungsten carbide crystals and/or particle and comprises micro-areas 7 of shape similar to oval, filled with an alloy based on metal, and the other one is a rim 8 surrounding it deprived of oval micro-areas filled with alloy. The cross-section of the layer with the selected magnified areas is presented in the FIG. 4. In order to assess the share of the reinforcing phase, one determined surface area content of phases identified within microstructure, i.e. flake graphite and base alloy representing the matrix of the composite layer and tungsten carbide representing the reinforcement phase. Exemplary microstructures with determined surface area content and the obtained results are presented in the FIG. 5. Surface share of tungsten carbides in this case is 25% and of the matrix 70%, the rest is graphite being the component of the basic alloy used to produce the cast. Moreover, average tungsten carbide particle size was estimated and it was determined as an average of two measurements of diagonals intersected at the right angle. The results show to bimodal size distribution of tungsten carbide within the composite layer that achieves the first distribution maximum for the distribution from 0.5 to 6 μm, and the other from 7 to 30 μm. The results are presented in the form of a histogram, as showed in the FIG. 6.

Example 3

In order to produce internal layer of the pump body that is subject to intense wear, the layers 5 comprising the composite material reinforced with ceramic phases particles, such as tungsten and titanium carbides, the casting mould core 1 is prepared. The reactive casting coating 2 is applied directly on the surface of the casting mould core 1 made of quartz sand and water glass and blown with $CO_2$. The coating 2 was made based on mixing 80% wt. of reaction substrates forming tungsten carbide and 20% wt. of reaction substrates forming titanium carbide. The mixture of powders of reaction substrates forming tungsten carbide was made in the weight ratio W:C equal to 94:6% wt. Reaction substrates forming TiC were prepared in atomic ratio 55% Ti: 45% C.

Figure 8:
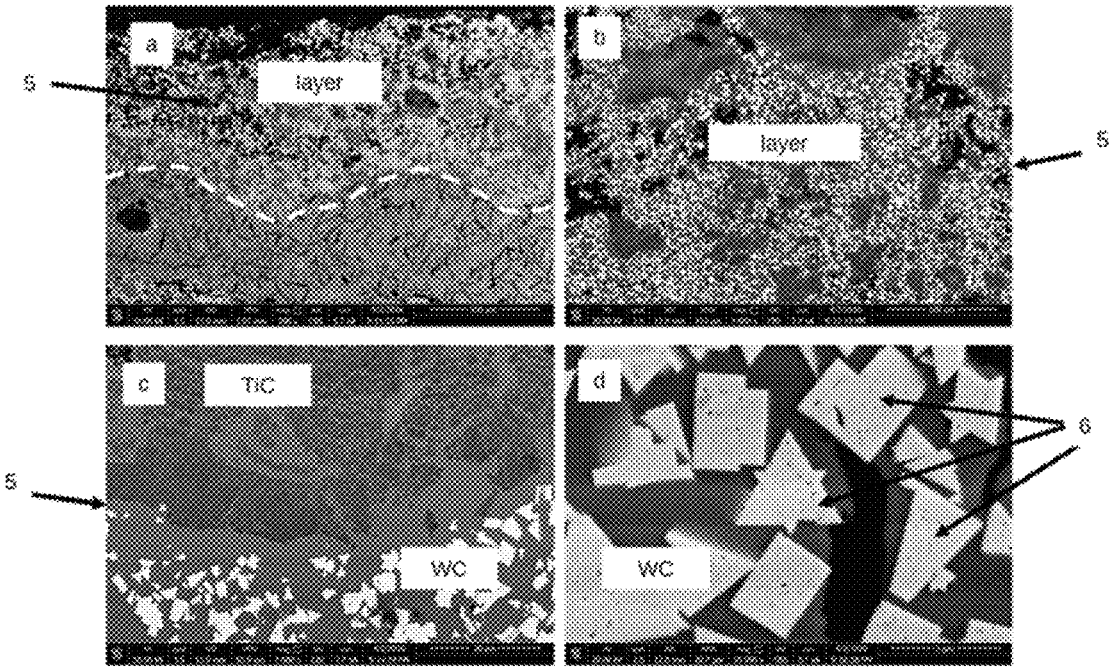
FIG. 8 presents the microstructure of the in situ composite layer produced using the mix of reactants forming two types of carbide (tungsten and titanium), subject to self-propagating high-temperature synthesis reaction.
Figure 9:
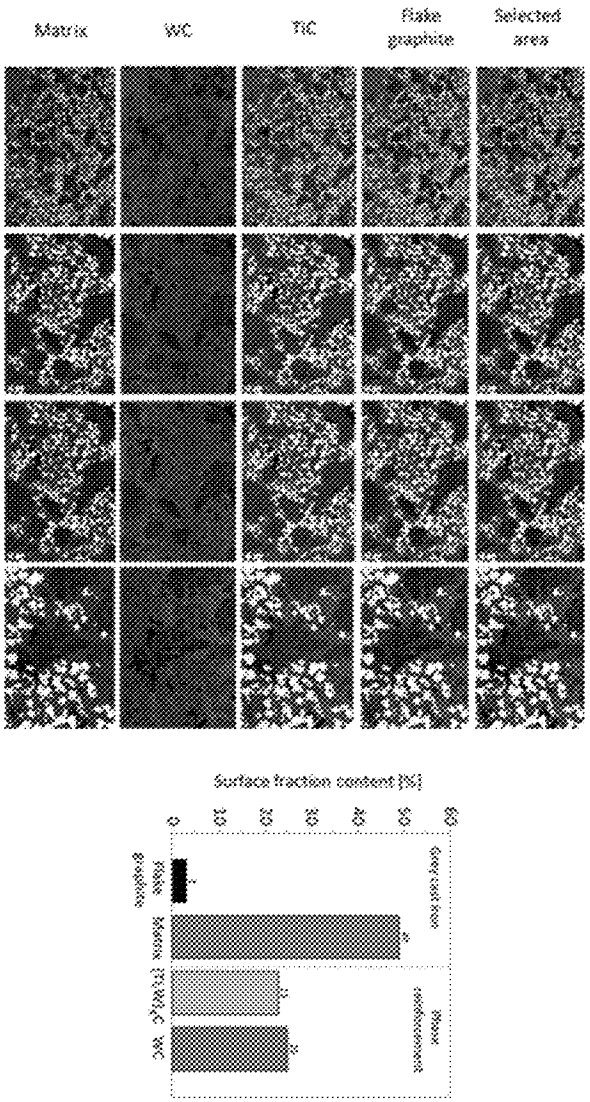
FIG. 9 presents the surface area content of individual phases representing the microstructure of the in situ composite layer produced using the mix of reactants forming two types of carbide (tungsten and titanium), subject to self-propagating high-temperature synthesis reaction.

In this case, the following powders were used: tungsten of micro-crystalline morphology and particle size ca. 4.5 μm, titanium of spongy morphology of particle size 44 μm and graphite of particle size below 5 μm. The prepared mixture of powders was introduced into liquid solution of colophony resin in ethyl alcohol representing the carrier and air dried gluing agent. Mutual ratio of the tungsten and graphite powders to liquid gluing agent was 4:1 parts by weight. The cast coating was prepared based on 600 g of powders mixture and 150 g of solution. The whole was subject to mixing in order to obtain uniform reactive consistency of the cast reactive coating 2. The mixed reactive cast coating 2 was applied by spraying with a spray gun 3. Then, the casting mould core 1 together with the applied reactive cast coating 2 was dried at temperature above 100° C. in order to remove residues of alcohol and moisture. The casting mould core 1 was installed inside the casting mould cavity, and then the mould was assembled and filled with liquid alloy. The pump 4, after the crystallization process had the microstructure of grey cast iron with flake graphite, however within the composite layer 5 area, the in situ particles of tungsten and titanium carbides were formed (FIG. 8). The obtained microstructure were used to determine the surface area content of individual phases representing microstructure of the produced in situ composite layer. The results are showed in the FIG. 9 considering the division of phases present within the area of the matrix and composite layer. The presence of irregular area of non-faceted particles of TiC within the microstructure indicates the addition of percentage share of pure TiC formation reaction substrates. Hardness test performed using Vickers method (HV1) under the load of 1 kG i.e. 9.81 N within the area of the base alloy and the composite layer showed the values at the level of 312.3 HV1 and 767.1 HV1 respectively. The obtained results indicate over twice increase of hardness of the top layer of the cast made together with the in situ composite layer.

The invention claimed is:

1. A cast structural element of at least one of a pump, filter or compressor together with a wear resistant in situ produced layer comprising:

composite material based on alloys reinforced with tungsten carbide in the form of at least one of crystals and particles, a microstructure of the composite material within the layer comprises at least one of faceted crystals and faceted particles of tungsten carbide that provide uniform macroscopic and microscopic distribution, wherein the at least one of faceted crystals and faceted particles of tungsten carbide include at least one selected from the group consisting of irregular, oval, round nano and micro-areas filled with an alloy based on metal; and wherein a mixture of powders to produce the composite material within the layer consists only of between 93-95% wt. tungsten powder and 5-7% wt. carbon powder.

2. The cast structural element according to claim 1, wherein the at least one selected from the group consisting of irregular, oval, round nano and micro-areas filled with an alloy based on metal are present within a internal part of the at least one of faceted crystals and faceted particles of tungsten carbide and within a external part, at walls, their structure is uniform, and the at least one of faceted crystals and faceted particles formed in situ in liquid alloy and are present within a matrix, wherein the matrix was formed after a alloy crystallization process.

3. The cast structural element according to claim 1, wherein a volume of at least one type of tungsten carbide within the layer comprising composite material is between 15 to 50% by volume.

4. The cast structural element according to claim 1, wherein a size of the at least one of faceted crystals and faceted particles of tungsten carbide within the layer comprising the composite material is between 0.5 and 30 μm.

5. The cast structural element according to claim 1, wherein within an area of the at least one of faceted crystal and faceted particle of tungsten carbide, a size of areas filled with the alloy based on metal is between 0.1 to 4.5 μm.

6. The cast structural element according to claim 1, wherein a. the tungsten powder is in the form of at least one of microcrystalline, nanocrystalline powder, and agglomerates of nanoparticles, and other carrier of high tungsten content, b. the carbon powder is at least one of graphite, high purity carbon, other carrier of high carbon content, and mixtures thereof.

7. The cast structural element according to claim 1, wherein a volume of at least one type of tungsten carbide within the layer comprising composite material is between 19 and 35% by volume.

8. The cast structural element according to claim 1, wherein the tungsten powder is in the amount of 94% wt. and the carbon powder is in the form of graphite in the amount of ca. 6% wt.

9. The cast structural element according to claim 8, wherein the carbon particles in the form of graphite have an average size of 5 μm or below.

10. A cast structural element of at least one of a pump, filter or compressor together with a wear resistant in situ produced layer comprising:

composite material based on alloys reinforced with tungsten carbide in the form of at least one of crystals and particles, a microstructure of the composite material within the layer comprises at least one of faceted crystals and faceted particles of tungsten carbide that provide uniform macroscopic and microscopic distribution, wherein the at least one of faceted crystals and faceted particles of tungsten carbide include at least one selected from the group consisting of irregular, oval, round nano and micro-areas filled with an alloy based on metal;

wherein a mixture of powders to produce the composite material within the layer consists only of between 93-95% wt. tungsten powder and 5-7% wt. carbon powder wherein another layer comprising the composite material comprises additional types of carbides or borides selected from the group consisting of TiC, MoC, NbC, ZrC, VC, TaC, TaB, $TiB_2$ and mixes thereof.

* * * * *